United States Patent [19]

Merrien et al.

[11] Patent Number: 4,573,522

[45] Date of Patent: Mar. 4, 1986

[54] PROCESS AND APPARATUS FOR AUTOMATING A BAKING CYCLE UNDER HOT AIR OF SAND MOLDS

[75] Inventors: Pierre L. Merrien, Billere; Pierre A. Merrien, Sceaux, both of France

[73] Assignee: Etude et Development en Metallurgie, Billere, France

[21] Appl. No.: 631,521

[22] Filed: Jul. 18, 1984

Related U.S. Application Data

[63] Continuation of Ser. No. 210,623, Nov. 26, 1980, abandoned.

[30] Foreign Application Priority Data

Nov. 28, 1979 [FR] France ..... 79 29227

[51] Int. Cl.[4] ..... B22D 46/00

[52] U.S. Cl. ..... 164/456; 164/12; 164/154

[58] Field of Search ..... 164/154, 150, 4.1

[56] References Cited

FOREIGN PATENT DOCUMENTS

| | | | |
|---|---|---|---|
| 2727794 | 1/1979 | Fed. Rep. of Germany | 164/456 |
| 2921403 | 11/1980 | Fed. Rep. of Germany | 164/12 |
| 45-36110 | 11/1970 | Japan | 164/154 |

*Primary Examiner*—Kuang Y. Lin

*Attorney, Agent, or Firm*—Sandler & Greenblum

[57] ABSTRACT

A process and apparatus for automating a hot-air baking cycle of sand molds. Such process and apparatus make it possible to regulate the hot-air baking or drying speed in a sand mold during a baking cycle. This regulation can be accomplished before casting, and in particular, before low-pressure casting. The process includes dividing the cycle into characteristic phases associated with particular baking parameters. The apparatus includes a calculator assembly for obtaining baking parameters. The invention can be used for the baking of foundry molds, and particularly, foundry molds for aeronautical parts.

17 Claims, 3 Drawing Figures

PROCESS AND APPARATUS FOR AUTOMATING A BAKING CYCLE UNDER HOT AIR OF SAND MOLDS

This application is a continuation of application Ser. No. 210,263, filed Nov. 26, 1980, and now abandoned.

TECHNICAL FIELD OF THE INVENTION

The present invention has for an object the regulation of hot air baking of foundry molds for diverse alloys, but particularly aluminum, adapted to be cast at low pressure.

BACKGROUND OF THE INVENTION

It is known that if one casts the molds made out of synthetic sand (silica, zircon for example connected by organic resins) without heating them first, one obtains elements with substantial risks of faults (blisters, micropores).

The heating of the core is generally carried out in an oven and the heating of the molds is generally carried out with a blowtorch. The mold is then assembled and closed before the casting.

However heating with the blowtorch is irregular and may not touch all of the surfaces, and in the interval of time necessary for the remolding before casting, the volatile products can return towards the impression.

In low pressure casting of sand molds, the metal is injected from bottom to top through the lower surface of the mold. In gravity casting, on the other hand, the mold thus has an orifice on the other side of the mold. Futhermore, the mold, having no deadhead, is without an orifice at the upper portion.

SUMMARY OF THE INVENTION

It is thus possible to provide at the lower portion a hot air inlet according to FIG. I which makes possible:

(1) heating of the assembled mold, ready for casting;

(2) radial heating pushing the volatile products towards the exterior of the impression; and (3) the possibility of casting immediately after the interruption of the drying.

Because these bakings are conducted empirically, the times, temperatures, and flow rates used are those which have in the past given good results. They must therefore be established statistically for each type of element.

In one embodiment, the invention relates to an automation process for a hot air baking cycle of a sand mold. The process comprises the steps of dividing the baking cycle into a plurality of phases, determining optimal baking parameters associated with each of the phases by hot air baking of the sand mold during a development stage, recording the parameters associated with each of the phases, casting sample in the mold, examining the surface of the sample for microporosities by means of flourescent sweating, establishing correlations between the recorded parameters and microporosities which exist at the surface of the sample, and regulating a hot air inlet to an oven used in the baking cycle in a manner so as to assure correspondence between the optimal parameters determined and those actually obtained during the performance of the baking cycle.

In another embodiment, the method of the present invention relates to an automation process for a hot air baking cycle for baking a mold, comprising a plurality of phases. The process comprises the steps of determining baking parameters associated with each of the phases by hot air baking of the mold, recording parameters associated with each of the phases, casting a sample in the mold, examining the surface of the sample for microporosities by means of flourescent sweating, establishing correlations between the recorded parameters and microporosities at the surface of the casting sample, and regulating the hot air inlet to the mold used in the baking cycle in a manner so as ensure correspondence between the parameters determined and those actually obtained during the performance of the baking cycle. In this embodiment, baking cycle comprises two phases. In the first phase, the volatile product concentration in the air at the upper portion of the mold is greater than or equal to that of an initial value. In the second phase, the volatile product concentration decreases slowly to maintain the mold until the casting of the casting element. In this embodiment, the regulating step is initiated in response to a signal from an analysis electrode for measuring the volatile product concentration.

In still another embodiment, the method of the present invention comprises an automated process for controlling hot air evaporation of volatile organic materials contained in the sand mole which is designed for low pressure casting. The process comprises the steps of separating the evaporation of the volatile organic materials into a plurality of phases, predetermining control parameters associated with the plurality of phases by recording the concentration of the organic materials evaporating from the sand mold over time, and establishing correlations between the concentrations over time and microporosities on the surface of a casting sample which is cast in the mold, and regulating the hot air entering the mold in an actual production cycle so that the actual parameters obtained in the course of an actual production cycle conform to the control parameters, whereby the evaporation of the volatile organic materials is carried out under pre-set conditions.

In this embodiment, the predetermining step further comprises pre-determining control parameters comprising the velocity of the decrease in the concentration of the volatile organic materials evaporating from the sand mold as a function of time. The regulating step further comprises regulating the velocity of the decrease in the concentration of the volatile organic materials evaporating from the sand mold in an actual production cycle to ensure conformity between the predetermined velocity and the actual velocity of decrease in the concentration of the volatile organic materials evaporating from the sand mold during of actual production cycle. In addition, the process further comprises determining the microporosities on the surface of the casting sample by the process of flourescent sweating.

In this embodiment, the separating step comprises the steps of separating the evaporation into first and second phases. The first phase comprises a beginning and an end. In the first phase, the concentration of volatile organic materials in the air that evaporates from the mold after the beginning is at a value equal to a higher than the volatile organic material concentration at the beginning of the first phase. In the second phase, the concentration of the volatile organic materials decreases below the value at the beginning of the first phase. In this embodiment, the regulating step begins in response to a signal from a means for determining the concentration of volatile organic materials in the air evaporating from the mold.

The predetermining step in this embodiment further comprises: heating the mold to vary the decrease in the velocity of evaporation of the volatile organic materials to produce an evaporation curve of the concentration of volatile organic materials over time; examining the external conditions of the casting sample; repeating these two previous steps a plurality of times to produce a plurality of curves; and establishing statistical correlations between the plurality of curves and the results of the examination of the external condition of the mold so as to determine an optimum evaporation curve for the mold, whereby the process uses the minimum amount of time and the minimum amount of energy in heating the mold to obtain a satisfactory casting.

In addition, the regulating step further comprises the steps of: measuring the actual change in the volatile organic materials concentration $\Delta C_R$ over a particular period of time $\Delta T$ and calculating the theoretical organic material concentration $\Delta C_T$ over the period of time $\Delta T$, based on the optimal evaporation curve by the formula $\Delta C_T = V_3 \Delta T$; comparing $\Delta C_R$ and $\Delta C_T$; and passing hot air into the mold if $\Delta C_R$ is less than or equal to $\Delta C_T$, and stopping the passing of hot air into the mold if $\Delta C_R$ is greater than $\Delta C_T$. In this embodiment, the hot air that is cast into the mold has a temperature of approximately 150°.

DETAILED DESCRIPTION OF THE INVENTION

It is an object of the present invention for hot air baking to be regulated to minimize heating time and intensity, making it possible to assure satisfactory conditions before low pressure molding.

The method consists of a process and an apparatus for its application.

The process includes dividing the baking operation into various phases and determining baking parameters for each phase.

Figure 2:
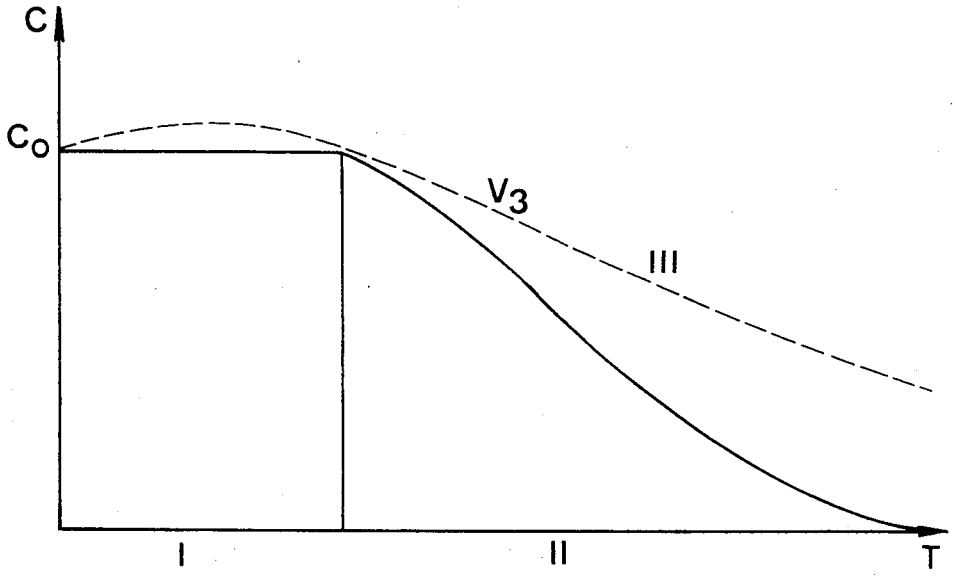
FIG. 2 is a graphical representation of an evaporation curve for volatile organic materials.

Hot air baking of sand molds under low pressure comprises two essential phases represented in FIG. 2.

Figure 1:
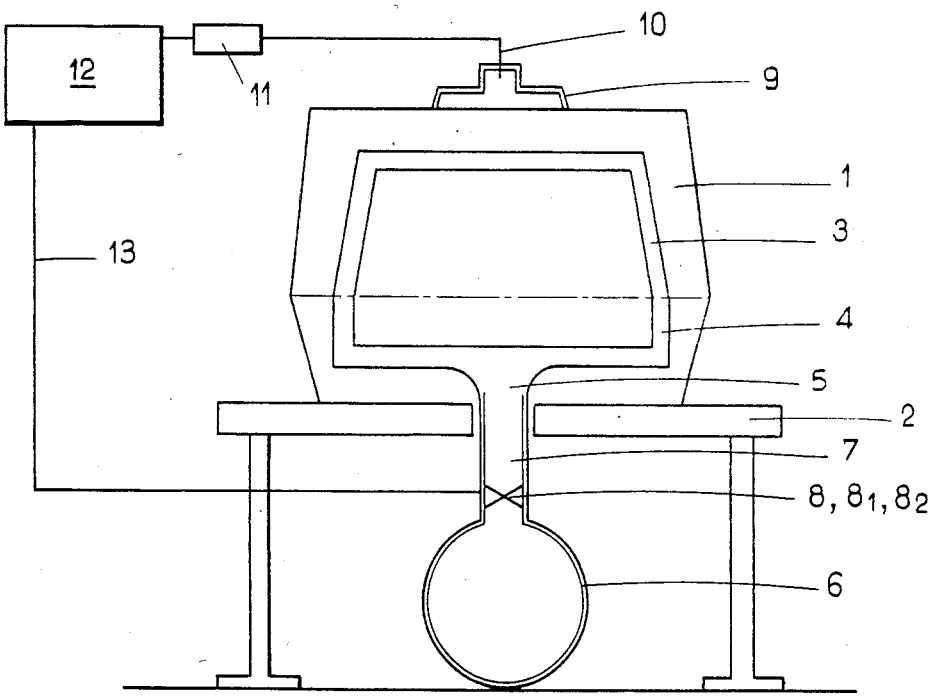
FIG. 1 illustrates a device for the hot-air baking of foundry molds for various alloys.

The curve in FIG. 2, as a function of time, the organic volatile materials concentration in the air leaving the upper surface of mold A in FIG. 1.

During Phase I the concentration of volatile materials remains substantially constant, or rises and then returns to its original value.

During Phase II the concentration decreases from this original value to the value 0.

In the present invention one replaces phase II, which describes the typical decrease in concentration of volatile organic materials evaporating from the mold, with a phase III in which the concentation of volatile organic materials evaporating from the mold decreases more slowly than in phase II.

This slow speed of decrease of concentration during Phase III assures appropriate maintenance of the sample before casting by introducing data in a pilot to control an automated valve which controls the inlet of air into the mold.

The embodiment according to FIG. 1 includes:

(1); a sand mold (1)
(2); placed on a plate (2)
(3); with its impression (3)
(4); its casting system (4)
(5); its inlet cone (5)
(6); a hot air line (6)
(7); an air inlet tube into the mold (7)
(8); an automated valve (8) p0 (9); a measurement device with a hood (9)
(10); an analysis electrode (10)
(11); a concentration recorder (11)
(12); an automation pilot (12)
(13); a control circuit (13) for controlling valve (8) which is automated by pilot (12).

Pilot 12 comprises:

(1) an inlet-outlet assembly;
(2) a calculator assembly; and
(3) a memory assembly, and can be constituted around microprocessors and electronic clocks.

The parameters of the base curve of FIG. 2 are introduced in the inlet-outlet assembly, i.e., (1) the speed $V_3$ of diminution of volatile materials concentration;
(2) the interval of time measured $\Delta T$; and
(3) the volatile materials concentration which at the start $C_0$, is taken as 0 in the system.

The calculator assembly performs the following functions:

(1) receives an indication of real concentration variation in time $\Delta T$ which is represented by $\Delta C_R$.
(2) calculates the theoretical concentration variation to be provided for the same interval $\Delta T$ by the formula:

$$\Delta C_T = V_3 \Delta T$$

(3) compares $\Delta C_R$ and $\Delta C_T$;
(4) controls
(a) the closing of the automated valve if $\Delta C_R > \Delta C_T$;
(b) the opening of the valve if $\Delta C_R \leqq \Delta C_T$ The regulation assembly is shown by the schematic diagram of FIG. (3).

Pilot 12 can receive information from several driers and regulate them in the same manner as for a single dryer using therefor. automated valves $8_1$-$8_2$-$8_3$ etc. The outlets towards the molds are all shunted on central hot air line (6).

The memory assembly receives and stores various values for speeds $V_3$ suited for different types of elements.

The apparatus is used as follows. During formation of the standard part, the drying curves is registered and the registered drying curves is compared with the surface reactions of the uncovered element which take the form of microporosities with fluorescent sweating.

The temperature of the air can, for example, be the range of 150° C.

What is claimed is:

1. An automation process for a hot air baking cycle of a sand mold, said process comprising the steps of:

(a) determining at least one optimal baking parameter associated with drying said mold by hot air baking of said sand mold during a calibration stage by:
(i) recording at least one parameter associated with drying said sand mold;
(ii) casting a sample in said mold;
(iii) examining the surface of said sample for microporosities by means of fluorescent sweating; and (iv) establishing correlations between the at least one recorded parameter and said microporosities on the surface of said sample to obtain at least one optimal drying parameter; and (b) regulating a hot air inlet for baking said sand mold before casting an element in a sand mold during a casting stage in a manner so as to assure correspondence between the at least one optimal parameter determined in step (a) and those actually obtained during step (b).

2. The process in accordance with claim 1 wherein said hot air baking of said sand mold in steps (a) and (b):

(i) increases the volatile product concentration in the air at the upper portion of the mold above an initial value;

(ii) then decreases the volatile product concentration in the air at the upper portion of the mold to said initial value; and (iii) finally, further decreases the volatile product concentration slowly below said initial value to maintain the mold until the casting of sample in the mold.

3. The process as recited in claim 1 wherein said regulating step (b) is initiated in response to a signal from an analysis electrode for measuring said volatile product concentration.

4. A process for hot air baking of a sand mold, said process comprising:

(a) a calibration procedure; and (b) a pre-casting procedure, wherein said calibration procedure comprises the step of:

(i) determining the optimal concentration of volatile organic materials evaporating from a sand mold over time, before casting in a mold so as to optimize said casting; and wherein said pre-casting procedure comprises the step of:

(i) heating a sand mold before casting in such a manner that the concentration of volatile organic materials over time evaporating from said mold recited in step (b) (i) is substantially the same as said optimal volatile organic material concentration.

5. The process defined by claim 4 wherein said determining step further comprises determining the optimal velocity of the decrease in concentration of said volatile organic materials evaporating from said sand mold as a function of time, and wherein said heating step further comprises regulating the velocity of the decrease in the concentration of said volatile organic materials evaporating from said sand mold to ensure conformity between said optimal velocity and the actual velocity of decrease in the concentration of said volatile organic materials evaporating from said sand mold during said step (b) (i).

6. The process defined by claim 4, wherein said heating step begins in response to a signal from a means for determining the concentration of volatile organic materials in the air evaporating from said mold.

7. The process defined by claim 4 wherein said determining step further comprises:

(aa) heating a mold to vary the velocity of decrease of the evaporation of said volatile organic materials to produce an evaporation curve of the concentration of said volatile organic materials over time;

(bb) casting a sample in said mold;

(cc) examining the external condition of said sample;

(dd) repeating step (aa), (bb), and (cc) a plurality of times to produce a plurality of samples and curves; and (ee) establishing correlations between said plurality of curves and the results of said examination of the external condition of said samples, so as to determine an optimal evaporation curve for a mold for a particular type of sample, whereby said process uses the minimum amount of time and the minimum amount of energy in heating said mold to obtain a satisfactory casting.

8. The process defined by claim 7 wherein said heating step comprises the steps of:

(i) measuring the actual change in the volatile organic materials concentration $\Delta C_R$ over a particular period of time and calculating the change in the optimal volatile organic material concentration $\Delta C_T$ over said period of time $\Delta T$, based on said optimal volatile organic material concentration over time, by the formula $\Delta C_T = V_3 \Delta T$;

(ii) comparing $\Delta C_R$ and $\Delta C_T$; and (iii) passing hot air into said mold if $\Delta C_R \leqq \Delta C_T$, and stopping the passing of hot air into said mold if $\Delta C_R > \Delta C_T$.

9. The process defined by claim 8 wherein said passing step (iii) comprises passing hot air having a temperature of approximately 150° C. into said mold if $\Delta C_R \leqq \Delta C_T$.

10. The process defined by claim 4 wherein said heating step comprises blowing hot air on said sand mold.

11. The process defined by claim 4 wherein said determining step comprises the steps of:

(aa) heating a sand mold to vary the concentration of the volatile organic materials evaporating from said sand mold;

(bb) recording the concentration of volatile organic material evaporating from said heated sand mold over time;

(cc) casting a sample in said previously heated sand mold;

(dd) examining the condition of said sample; and (ee) establishing a correlation between the condition of said sample and said concentration of volatile organic materials evaporating from said heated sand mold over time.

12. The process defined by claim 11 wherein said determining step further comprises:

(ff) repeating steps (aa), (bb), (cc), and (dd) a plurality of times to produce a plurality of evaporation curves representing a plurality of volatile organic material concentrations over time; and (gg) establishing correlations between said plurality of curves and the results of said examination of said samples so as to determine an optimum evaporation curve for a particular type of sample.

13. The process defined by claim 11 wherein said heating step (b) (i) comprises the step of:

(aa) blowing hot air on said mold recited in step (b) (i);

(bb) measuring the concentration of volatile organic materials over time evaporating from said mold recited in step (b) (i);

(cc) comparing the concentration of volatile organic materials over time evaporating from said mold with said recorded concentration of volatile organic material; and (dd) adjusting the flow of said blowing hot air so that said concentration of volatile organic materials over time measured in step (b) (i) (bb) conforms to said recorded concentration of volatile organic material over time.

14. The process defined claim 12 wherein said heating step (b) (i) comprises the steps of:

(aa) blowing hot air on said mold recited in step (b) (i);

(bb) measuring the concentration of volatile organic materials over time evaporating from said mold recited in step (b) (i);

(cc) comparing the concentration of volatile organic materials over time evaporating from said mold with said optimal evaporation curve; and (dd) adjusting the flow of said blowing hot air so that said concentration of volatile organic materials over time measured in step (b) (i) (bb) conforms to said optimal evaporation curve.

15. The process defined by claim 11 wherein said examining step (dd) comprises the step of examining microporosities on the surface of said sample by the process of fluorescent sweating.

16. The process defined by claim 4 wherein said heating step comprises the steps of:

measuring the actual charge in volatile organic materials concentration $\Delta C_R$ over a particular period of time $\Delta T$ and calculating the change in the optimal volatile organic material concentration $\Delta C_T$ over said period of time $\Delta T$, based upon said optimal volatile organic material concentration over time by the formula $\Delta C_T = V_3 \Delta T$;

comparing $\Delta C_R$ and $\Delta C_T$; and passing hot air into said mold if $\Delta C_R \leqq \Delta C_T$ and stopping the passing of hot air into said mold if $\Delta C_R > \Delta C_T$.

17. The process defined by claim 4 wherein said heating step (b) (i) comprises the step of:

(aa) blowing hot air on said mold recited in step (b) (i);

(bb) measuring the concentration of volatile organic materials over time evaporating from said mold recited in step (b) (i);

(cc) comparing the concentration of volatile organic materials over time evaporating from said mold with said optimal concentration of volatile organic material; and (dd) adjusting the flow of said blowing hot air so that said concentration of volatile organic materials over time measured in step (b) (i) (bb) conforms to said optimal concentration of volatile organic material over time.

* * * * *

UNITED STATES PATENT AND TRADEMARK OFFICE

CERTIFICATE OF CORRECTION

PATENT NO. : 4,573,522

DATED : March 4, 1986

INVENTOR(S) : Pierre L. MERRIEN et al.

Figure 3:
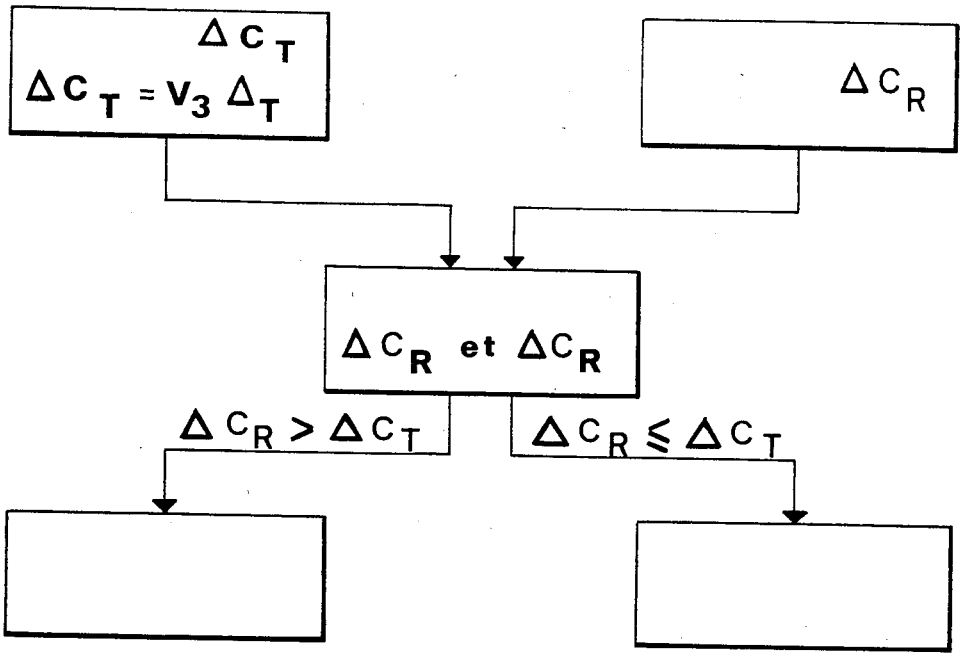
FIG. 3 is a block diagram of a pilot of the apparatus according to the present invention.
Figure 3:
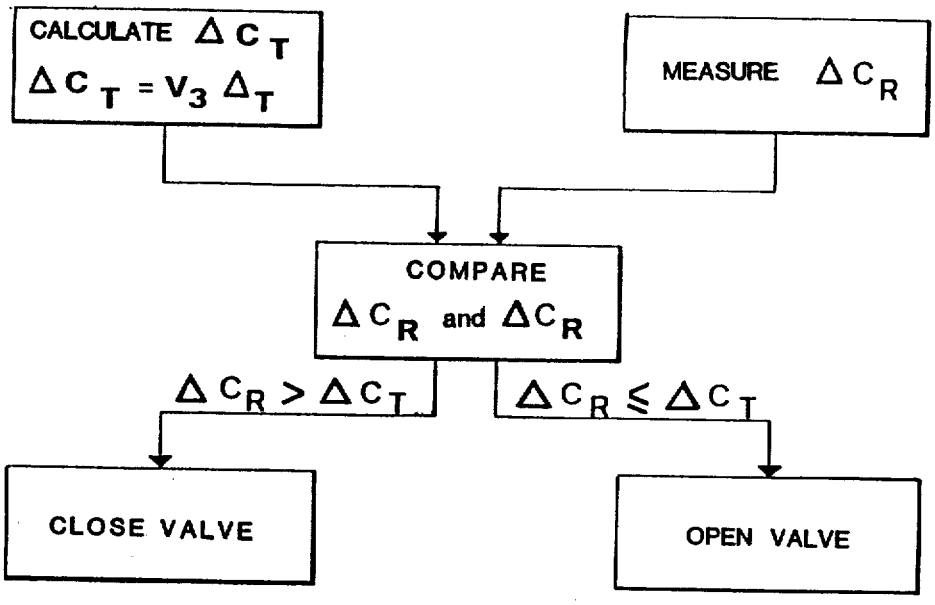

It is certified that error appears in the above-identified patent and that said Letters Patent is hereby corrected as shown below:

Column 2, line 24, change "mole" to ---mold---.
Column 2, line 60, delete "equal to a".
Column 3, line 49 after "Fig. 2" insert ---gives---.
Column 3, line 60, change "concentation" to ---concentration---.
Column 4, line 8, delete "p0" and place "(9); a measurement de-" on line 9 of column 4.
Column 4, line 51, change "is" to ---are---.
Column 4, line 52, change "is" to ---are---.
Column 7, line 24, change "charge" to ---change---.
In Fig. 3, the upper left hand box, before "$\Delta C_T$" add: ---calculate---, as per attached corrected Fig. 3.
In Fig. 3, upper right hand box, before "$\Delta C_R$" add: ---measure---, as per attached corrected Fig. 3.
In Fig. 3, the central box, above "$\Delta C_T$" and "$\Delta C_R$" add: ---compare---, as per attached corrected Fig. 3.
In Fig. 3, the central box, change "et" to ---and---, as per attached corrected Fig. 3.
In Fig. 3, the lower left hand box, please add: ---close valve---, as per attached corrected Fig. 3.
In Fig. 3, the lower right hand box, please add: ---open valve---, as per attached corrected Fig. 3.

Signed and Sealed this

Twenty-third Day of September 1986

[SEAL]

Attest:

DONALD J. QUIGG

Attesting Officer

Commissioner of Patents and Trademarks